United States Patent [19]

Miyashita

[11] 4,420,152

[45] Dec. 13, 1983

[54] APPARATUS FOR PEELING OR SEPARATING A RECORD PAPER FROM A PHOTOSENSITIVE DRUM OF AN ELECTROPHOTOGRAPHIC COPYING MACHINE

[75] Inventor: Kiyoshi Miyashita, Hachioji, Japan

[73] Assignee: Olympus Optical Company Limited, Tokyo, Japan

[21] Appl. No.: 291,773

[22] Filed: Aug. 10, 1981

Related U.S. Application Data

[63] Continuation of Ser. No. 116,825, Jan. 30, 1980, abandoned.

[30] Foreign Application Priority Data

Feb. 2, 1979 [JP] Japan ..... 54-11135

[51] Int. Cl.[3] ..... B65H 29/56

[52] U.S. Cl. ..... 271/309; 271/311; 271/DIG. 2

[58] Field of Search ..... 271/307, 309, 310, 311, 271/312, 313, 195, DIG. 2, 308; 355/3 SH, 3 R, 145 H

[56] References Cited

U.S. PATENT DOCUMENTS

| | | | |
|---|---|---|---|
| 1,595,478 | 8/1926 | Minton | 271/DIG. 2 X |
| 3,506,259 | 4/1970 | Caldwell et al. | 271/307 X |
| 3,804,401 | 4/1974 | Stange | 271/DIG. 2 X |
| 3,867,026 | 2/1975 | Ogawa | 271/DIG. 2 X |
| 3,923,391 | 12/1975 | Washio et al. | 355/14 SH X |
| 3,951,540 | 4/1976 | Ogawa | 355/8 |
| 3,955,813 | 5/1976 | Edwards | 271/309 |
| 4,000,942 | 1/1977 | Ito et al. | 271/DIG. 2 X |

*Primary Examiner*—Bruce H. Stoner, Jr.
*Assistant Examiner*—James Barlow
*Attorney, Agent, or Firm*—Fleit, Jacobson, Cohn & Price

[57] ABSTRACT

An apparatus for peeling or separating a record paper from a photosensitive drum of an electrophotographic copying machine immediately after a toner image formed on the photosensitive drum has been transferred onto the record paper comprising a pair of pawls each for peeling a respective side edge of the record paper off the drum, a duct for blowing an air stream in a space between the paper and the drum, and first and second guide plates arranged subtantially in parallel with each other to define a paper passage along which the peeled paper is fed, a plurality of elongated holes being formed in the first and second guide plates so as to introduce an air stream into the passage, which air stream serves to press the paper against the second guide plate, a front edge of the first guide plate being recessed in V-shape or convex manner in a direction of a paper feeding and/or being made apart from the second guide plate in a direction perpendicular to the paper feeding direction, so that a curved front edge of record paper does not strike against the front edge of first guide plate.

12 Claims, 7 Drawing Figures

APPARATUS FOR PEELING OR SEPARATING A RECORD PAPER FROM A PHOTOSENSITIVE DRUM OF AN ELECTROPHOTOGRAPHIC COPYING MACHINE

This is a continuation of application Ser. No. 116,825 filed Jan. 30, 1980 now abandoned.

BACKGROUND OF THE INVENTION

This invention relates to an apparatus for peeling a record paper having a toner image transferred thereto off a charge retentive member in an electrophotographic copying machine.

In many electrophotographic copying machines an electrostatic charge image formed on a charge retentive drum is developed with a dry toner developing agent to form a toner image and then the toner image is transferred onto a record paper by means of a transferring member. In such a copying machine a transfer roller is usually provided for pressing the record paper against the charge retentive drum and the record paper is liable to be stuck onto the charge retentive drum. Therefore there is provided an apparatus for peeling the record paper having the toner image transferred thereon off the charge retentive drum.

In U.S. patent application Ser. No. 30,629 filed on Apr. 19, 1979, and assigned to the same assignee as the present invention, now abandoned a paper peeling apparatus for use in an electrophotographic copying machine, said peeling apparatus comprising a pair of pawls each for peeling a respective side edge of the record paper off the charge retentive member, first and second guide plates arranged substantially in parallel with each other for defining a passage for the record paper, a duct for supplying an air stream into a space between the record paper and charge retentive member, and a plurality of openings formed in the first guide plate for passing an air stream into said passage so as to press the record paper against the second guide plate.

In a preferred embodiment said air stream is produced by a fan which generates a suction air stream for collecting residual toner particles removed from the charge retentive member by a rotating cleaning brush.

In such a peeling apparatus there can be obtained advantage that the record paper can be effectively peeled off the charge retentive member although a construction is simple and the number of necessary parts is small. After conducting various tests for this peeling apparatus the inventor has found that the pawls can initiate the peeling operation and the side edges of record paper are at first separated from the charge retentive drum, but at this time a central portion of record paper is still made in contact with the drum. Therefore the front edge of record paper is curved toward the drum. When the paper is curved, its regidity becomes large and thus it is rather difficult to change the feeding direction of the record paper along the transfer roller. Therefore the front edge of record paper sometimes strikes against a front edge of first guide plate and might be jammed. Further the record paper has the toner image which has not yet been fixed on that surface which is brought into contact with the inner surface of first guide plate. Thus the toner image on the record paper might be damaged or deteriorated.

SUMMARY OF THE INVENTION

The present invention has for its object to provide a paper peeling apparatus for use in an electrophotographic copying machine which can positively peel a paper off a charge retentive member after a toner image formed on the charge retentive member has been transferred onto the paper and can guide smoothly without jamming the paper into a succeeding fixing device without damaging the toner image on the paper.

According to the invention an apparatus for peeling a record paper having a toner image transferred thereon by means of a transferring member off a charge retentive member of an electrophotographic copying machine comprises a pair of pawls each for peeling a respective side edge of the record medium from the charge retentive member; a duct for blowing an air stream in a space between the record medium and the charge retentive member; and first and second guide plates arranged substantially in parallel with each other for defining a passage through which the record medium peeled off the charge retentive member is fed in such a manner that the toner image retentive surface of the record paper is opposed to an inner surface of the first guide plate, at least one opening being formed in the first guide plate, through which opening an air stream is introduced into said passage so as to press the record paper against the second guide plate and at least a central portion of a front edge of the first guide plate being made sufficiently apart from the second guide plate viewed in a direction perpendicular to a feeding direction of the record paper and/or being recessed from the charge retentive member in the feeding direction of the record paper, such that a curved front edge of the record paper does not strike against the front edge of first guide plate.

In a preferred embodiment of the record paper peeling apparatus according to the invention a plurality of upright guide projections are secured on the inner surface of the first guide plate.

DESCRIPTION OF THE PREFERRED EMBODIMENTS

Figure 1:
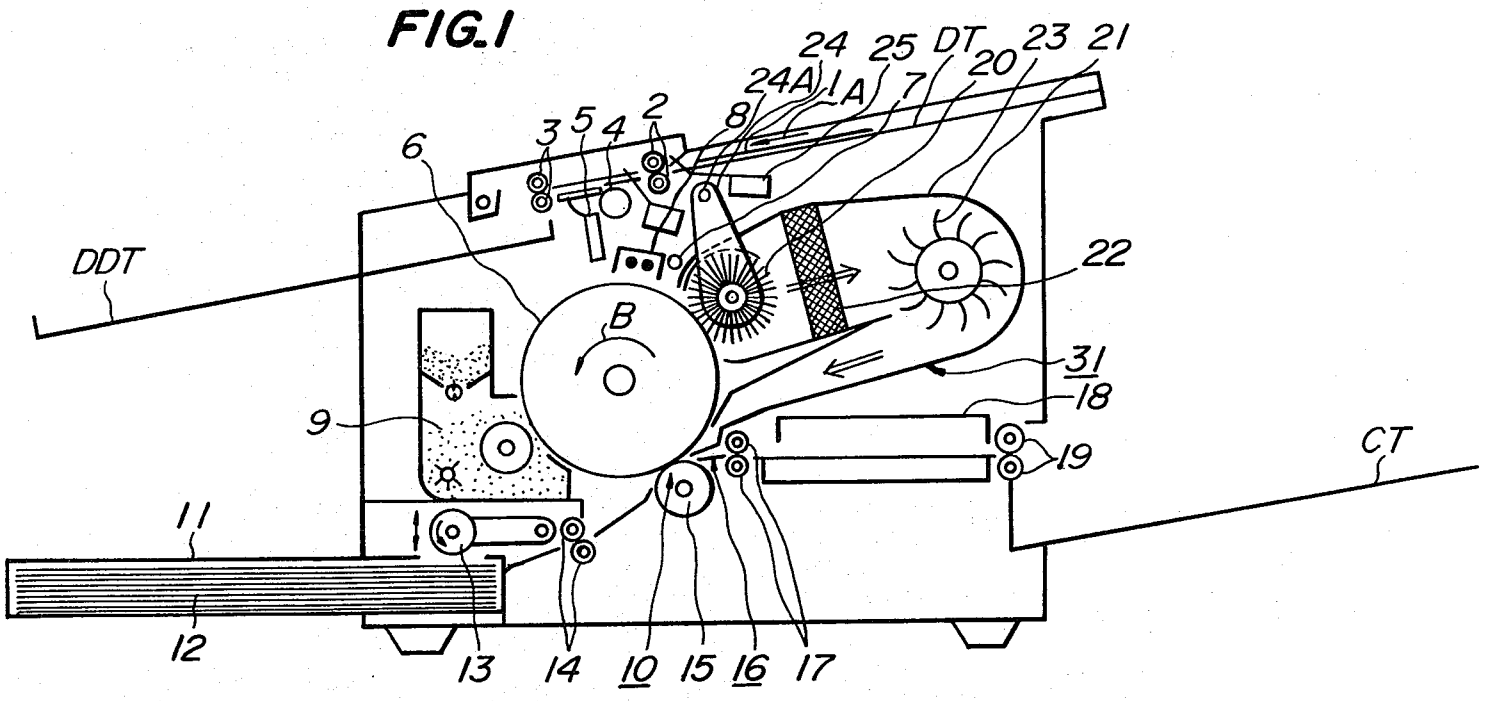
FIG. 1 is a schematic view showing an embodiment of an electrophotographic copying machine.

FIG. 1 is a schematic view showing an embodiment of an electrophotographic copying machine comprising a record paper peeling apparatus according to the invention. When a sheet like document 1 is placed on an inclined document table DT and is inserted into a document feed apparatus in a direction shown by an arrow A, the document is fed at a constant speed by means of feeding rollers 2 and 3 and is discharged on a document discharge table DDT. During this feeding the document 1 is illuminated by a lamp 4 and an image of the document is projected by means of an optical system 5 onto a rotating photosensitive drum 6. The drum 6 is rotated at a constant speed in a direction shown by an arrow B. At first any residual charge on the drum surface is erased by an erasing lamp 7 and then the drum surface is uniformly charged by a corona charger 8. When the uniformly charged drum surface is subjected to the imagewise exposure, an electrostatic latent image is formed on the drum surface. Then the latent image is developed with toners by a developing device 9 of a magnetic brush type. Upon further rotation of the drum 6 the toned image is transported into a transfer section 10. Record papers 12 in a paper cassette 11 are picked-up one by one by means of a swinging and rotating pick-up roller 13 and are successively supplied to the transfer section in which the record paper 12 is fed between the drum 6 and a semiconductive transfer roller 15 to which a suitable transfer bias potential is applied and the toned image on the drum surface is transferred onto the record paper 12. In the transfer section 10 the record paper is intimately brought in contact with the drum surface. The record paper 12 is peeled off the drum 6 by means of a peeling apparatus which will be explained later and is fed into a fixing device 18 by means of a guide system 16 and feeding rollers 17. The toner image is fused onto the record paper to form a final hard copy which is discharged by rollers 19 onto a copy tray CT. The toner image on the drum 6 is not wholly transferred onto the record paper, but a part thereof remains on the drum 6. The residual toner particles on the drum 6 are removed by a rotating cleaning brush 20 and the removed toner particles are sucked by a fan 21 and collected by a filter 22. In order to suck and collect the toner particles effectively the brush 20 and fan 21 are enclosed by a casing 23. In the present copying machine a plurality of copies can be formed from the same and single electrostatic charge image once formed on the drum 6 by repeating in succession the developing and transferring operations. During such a retention mode printing the cleaning operation is preferably omitted. For this purpose the cleaning brush 20 is arranged on an arm 24 journaled about a shaft 24A and during the retention mode printing the cleaning brush 20 is made apart from the drum 6. Further in order to initiate the operation of the copying machine and control various portions thereof in response to the insertion of the document into the document feed apparatus a plurality of microswitches for detecting the document are provided (in the drawing only one of the microswitches 25 is shown).

In the present embodiment an air stream produced by the cleaning fan 21 is conducted along a duct 31 an outlet of which is opened at the transfer section 10 so as to blow an air stream in a space between the paper and the drum. Then the air stream serves to peel the record paper 12 from the drum surface. In this manner additional fan and motor for generating the peeling air stream can be dispensed with and thus the construction is rather simple and the copying machine can be made smaller in size. Further the motor for driving the fan 21 may be commonly used as a main motor for driving the various parts such as the drum, and various kinds of rollers.

In case of printing a plurality of copies from the same and single charge image it is particularly important the record paper 12 should be made apart from the drum immediately after the record paper is peeled off the drum and should be fed along the transfer roller 15. If a rear surface of the record paper 12 is not made in contact with the semiconductive transfer roller 15 after the record paper has been separated from the drum 6, charge on the rear surface of record paper might be discharged to the drum 6 so as to damage or deteriorate the electrostatic charge image on the drum 6. This could be obviated by increasing a diameter of the transfer roller. However this solution has only a limited effect, because the size of transfer roller could not be made large extremely. Then according to the invention the guide system 16 is provided near the transfer roller 15 and the record paper is fed along the guide system 16. Then the record paper can be fed along the desired path closer to the transfer roller 15.

Figure 2:
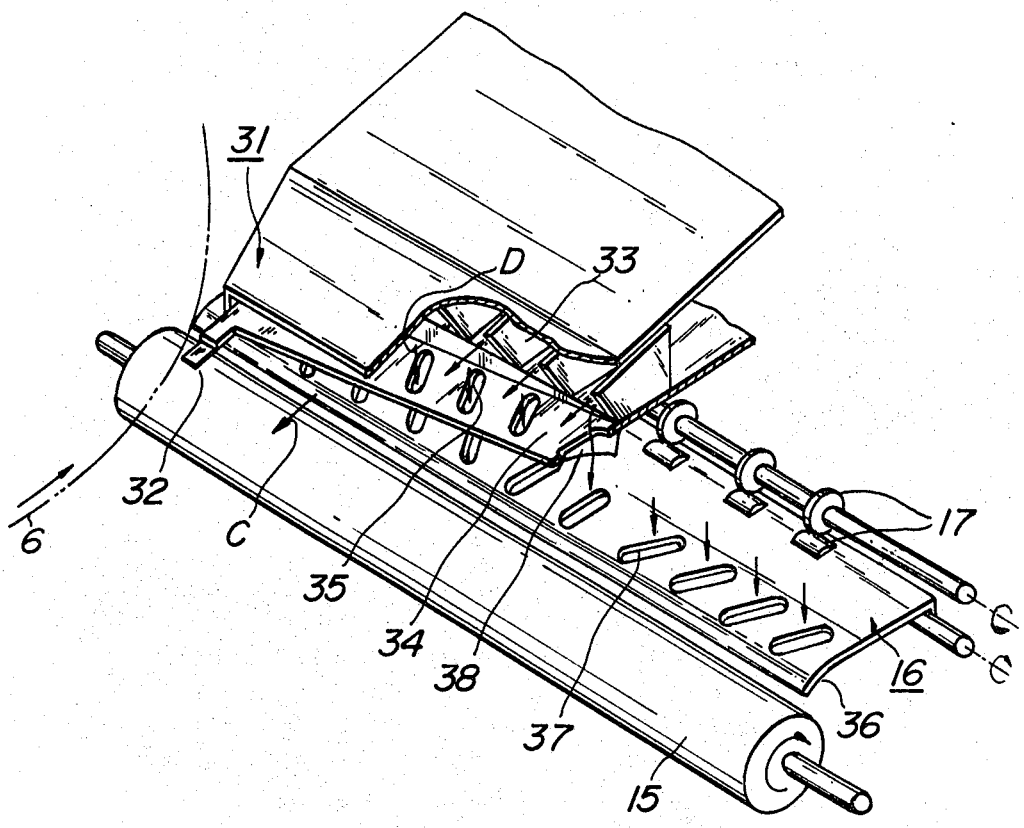
FIG. 2 is a perspective view illustrating an embodiment of a record paper peeling apparatus according to the invention.
Figure 3:
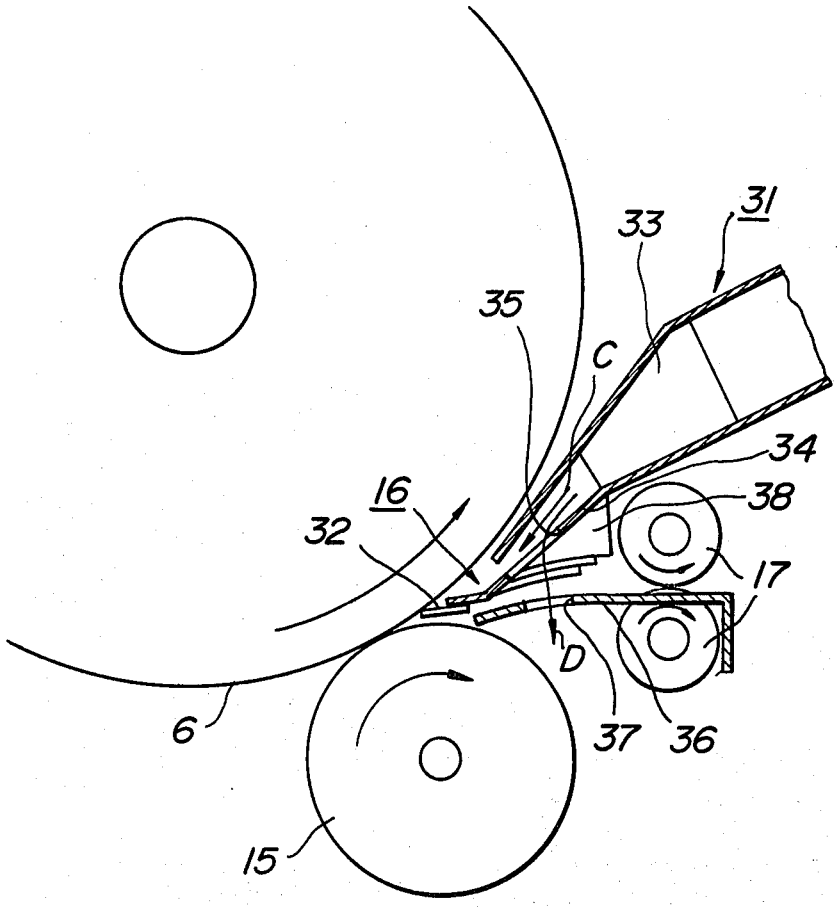
FIG. 3 is a cross sectional view showing the peeling apparatus of FIG. 2.

FIGS. 2 and 3 show an embodiment of the apparatus according to the invention for peeling the record paper off the drum 6 and the air duct 31 for blowing the peeling air stream, the transfer roller 15, the guide system 16, peeling pawls 32, etc. are illustrated. In the duct 31 are provided plates 33 for regulating the air stream. One of plates 34 for defining the duct 31 serves as a first upper guide plate and a plurality of elongated holes 35 are formed in the first guide plate 34, through which holes a part of the air stream flows into a passage defined by the first upper guide plate 34 and a second lower guide plate 36. At both ends of the lower plate 34 are secured pawls 32 each of which serves to peel a respective side edge of record paper off the drum 6. Then the air stream flows in a direction shown by an arrow C and enters in the space between the paper and the drum 6. Then the paper is peeled off the drum 6 along its whole width. Due to a flexibility or rigidity of the paper the paper is at first guided along the rear surface of the plate 34. When a front edge of paper advances by about 10 to 15 mm from a contact point between the drum 6 and roller 15, the paper is forcedly bent by the air flow through the holes 35 toward the transfer roller 15. Then the air stream shown by the arrow C is blocked by the paper and an inside atmosphere becomes high. Therefore the air stream D through the openings 35 becomes strong. Then the paper is urged against the transfer roller 15 and the second lower guide plate 36. FIG. 3 clearly shows a mutual position of the drum 6, duct 31, pawls 32, upper and lower plates 34 and 36 of the guide system 16. In the lower guide plate 36 are also formed a number of holes 37 which serve to escape the air between the paper and the lower guide plate 36 so as to bring the paper in contact with the plate 36. If these holes 37 would not be formed, the paper might vibrate up and down between these plates 34 and 36 and could not be fed in a stable manner. As the paper advances on the lower guide plate 36 the holes 37 are gradually blocked and the pressure between the upper guide plate 34 and the paper becomes higher, so that a force for pressing the paper against the lower guide plate 36 increases. In this manner the paper is fed stably along the lower guide plate 36 and is further supplied to the fixing device 18 by means of the rollers 17.

According to the invention it has been found that the first upper guide plate 34 plays an important role for feeding the front portion of the record paper during a time period from an instance at which the front edge of paper is peeled off the drum 6 to an instance at which the paper is pressed against the second lower guide plate 36 and should have special construction. As described above the record paper is peeled off the drum at first at the both side edges by means of the pawls 32. In this case a central portion of the front edge of paper is still stuck to the drum and thus the paper is deformed in such a manner that its center portion is bent upwards, i.e. toward the drum 6. Then the front edge of record paper is made contact with the upper guide plate 34 and is fed along the plate 34 for a moment. In this case it should be noted that the rigidity of the bent paper is rather high and its apparent thickness viewed from the feeding direction is large. Therefore if the distance between the upper and lower guide plates 34 and 36 is small, the front edge of paper might strike against the front edge of first upper guide plate 34 at its central raised portion, and thus a paper jam might occur. On the contrary if the distance between the upper and lower guide plates 34 and 36 is made larger, the paper jam could be overcome, but the central portion of paper might be brought in contact with the lower surface of upper plate 34. Since the toner image which has not yet been fixed is formed on the record paper, the contact of the paper with the upper guide plate 34 results in damage or deterioration of the toner image. According to the invention in order to solve the above mentioned problems in a sophisticated manner the front edge of the upper guide plate 34 is recessed toward the feeding direction and/or is bent in the direction in which the central portion of record paper projects.

In the embodiment shown in FIGS. 2 and 3 the front edge of upper guide plate 34 is tapered in a V-shaped manner toward the feeding direction of record paper and at the same time the central portion of plate 34 is bent upward in a V-shaped manner. Therefore the edge of central portion of record paper bent upward does not strike against the front edge of upper guide plate 34 and thus the paper can be smoothly fed. In this embodiment a plurality of upright guide projections 38 are secured on the inner surface of first upper guide plate 34. The active edges of these guide projections 38 are curved such that they can guide the paper in a stable and smooth manner. Further these upright guide projection 38 are aligned along a curved line which is recessed in the paper feeding direction. Therefore at first the side portions of record paper are brought into contact with the guide projections provided near the side edges and then the central portion of record paper is gradually made in contact with the upright guide projections near the center.

Figure 4:
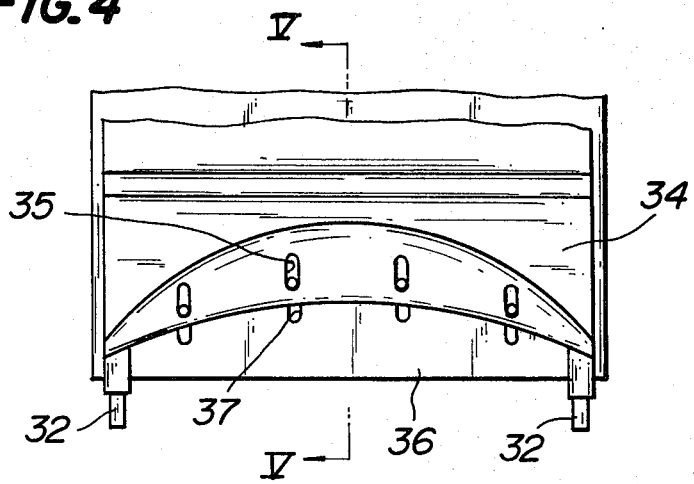
FIG. 4 is a plan view depicting another embodiment of the peeling apparatus according to the invention.
Figure 5:
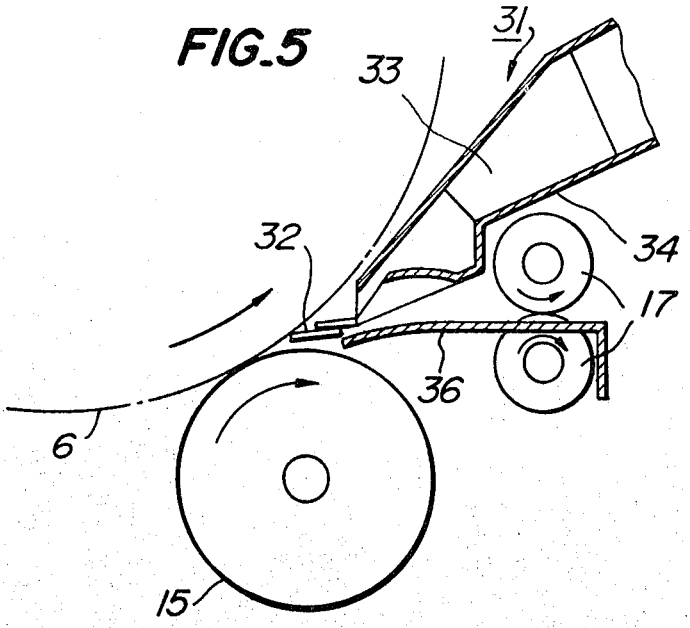
FIG. 5 is a cross section cut along a line V—V in FIG. 4.

FIGS. 4 and 5 show another embodiment of the paper peeling apparatus according to the invention. In this embodiment the same portions as those shown in FIGS. 2 and 3 are denoted by the same reference numerals. In the present embodiment a first upper guide plate 34 and a second lower guide plate 36 have formed therein a number of holes 35 and 37. A front edge of the upper guide plate 34 is curved in a convex manner in the direction of paper feeding and at the same time is bent upward in a convex manner. Therefore the front edge of the paper does not strike against the front edge of the upper guide plate 34 and the paper is fed smoothly without being jammed. In the present embodiment although no upright guide projection is provided on the inner surface of upper guide plate 34, the front edge of the paper is slid along the curved inner surface of plate 34 in a stable and smooth manner.

Figure 6:
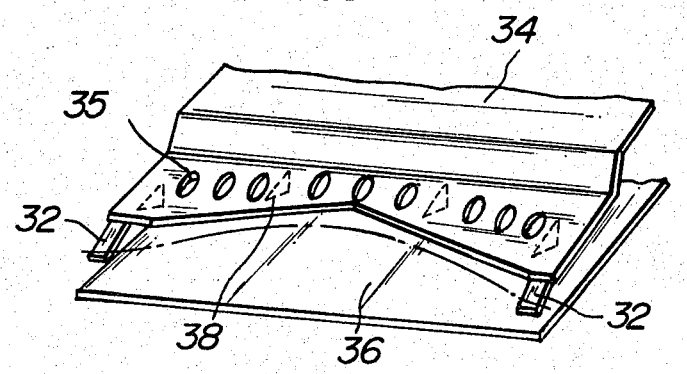
FIG. 6 is a perspective view illustrating another embodiment of the peeling apparatus according to the invention.

FIG. 6 is a perspective view illustrating another embodiment of the paper peeling apparatus according to the invention. In the present embodiment a central edge portion of a first upper guide plate 34 is recessed in a V-shaped manner in the direction of paper feeding and a plurality of upright guide projections 38 are secured on an inner surface of upper guide plate 34. The upright projections 38 are also aligned along a V-shaped line recessed in the paper feeding direction.

Figure 7:
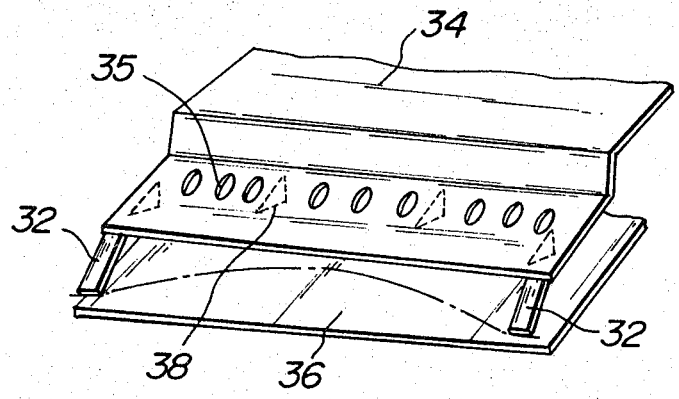
FIG. 7 is a perspective view showing still another embodiment of the peeling apparatus according to the invention.

FIG. 7 is a perspective view showing still another embodiment of the paper peeling apparatus according to the invention. In this embodiment a distance between upper and lower guide plates 34 and 36 is made larger than an apparent thickness of a curved paper shown by a chain line. Therefore the front edge of paper does not strike against the front edge of upper guide plate 34. On the inner surface of upper guide plate 34 are also secured a plurality of upright projections 38 and the projections near the central portion are made further apart from the drum than the projections near the side portions. Therefore the record paper can be smoothly guided by the projections 38 which are made in contact with the paper in a line contact manner.

In the above embodiments the openings 37 in the second guide plate 36 are formed as elongated holes which extend at angles with respect to the paper feed direction, so that the front edge of record paper is hardly engaged with the holes.

According to the invention the record paper can be positively peeled off the charge retentive member and can be smoothly fed along the transfer roller to the succeeding fixing station without being jammed by suitably configurating the front edge of the first guide plate. Further the toner image which has not yet been fixed cannot be damaged by the guide plate.

The present invention is not limited to the embodiments explained above, but may be modified in various manner within the scope of the invention. For instance, the charge retentive member may be formed as a photosensitive belt or sheet. Further charge retentive member may be constituted as an electrically insulating drum, belt or sheet. In this case the electrostatic charge image may be formed by a known TESI method or an ion modulation method with a photosensitive screen.

What is claimed is:

1. An apparatus for peeling a record paper having a toner image transferred thereon by means of a transferring member off a charge retentive member of an electrophotographic copying machine, comprising: a pair of pawls, each of said pawls employed to peel a respective side edge of the record paper from the charge retentive member; a duct for blowing an air stream in a space between the record paper and the charge retentive member; and first and second guide plates arranged substantially in parallel with each other for defining a passage through which the record paper peeled off the charge retentive member is fed in such a manner that the toner image retentive surface of the record paper is opposed to an inner surface of the first guide plate, at least one opening being formed in the first guide plate, through which opening an air stream is introduced into said passage so as to press the record paper against the second guide plate, a front edge of said first guide plate is recessed in a V-shaped manner in the paper feeding direction, and the record paper does not strike against the front edge of said first gude plate.

2. An apparatus according to claim 1, wherein the front edge of said first guide plate is bent in a V-shaped manner in the direction perpendicular to the paper feeding direction.

3. An apparatus according to claim 2 further comprising a plurality of upright guide projections secured to an inner surface of said first guide plate.

4. An apparatus according to claim 2, wherein active edges of the upright guide projections are curved in a concave manner.

5. An apparatus according to claim 2, wherein a plurality of upright guide projections are aligned along a curved line a central portion of which is set back from the charge retentive member in the paper feeding direction.

6. An apparatus according to claim 1, further comprising a plurality of upright guide projections secured to an inner surface of said first guide plate.

7. An apparatus according to claim 6, wherein active edges of the upright guide projections are curved in a concave manner.

8. An apparatus according to claim 6, wherein a plurality of upright guide projections are aligned along a curved line a central portion of which is set back from the charge retentive member in the paper feeding direction.

9. An apparatus for peeling a record paper having a toner image transferred thereon by means of a transferring member off a charge retentive member of an electrophotographic copying machine, comprising: a pair of pawls, each of said pawls employed to peel a respective side edge of the record paper from the charge retentive member; a duct for blowing an air stream in a space between the record paper and the charge retentive member; and first and second guide plates arranged substantially in paralllel with each other for defining a passage through which the record paper peeled off the charge retentive member is fed in such a manner, that the toner image retentive surface of the record paper is opposed to an inner surface of the first guide plate, at least one opening being formed in the first guide plate, through which opening an air stream is introduced into said passage so as to press the record paper against the second guide plate, a front edge of said first guide plate is recessed in a convex manner in the paper feeding direction and is bent in a convex manner in a direction perpendicular to the paper feeding direction, whereby a curved front edge of the record paper does not strike against the front edge of said first guide plate.

10. An apparatus according to claim 9, further comprising a plurality of upright guide projections secured to an inner surface of said first guide plate.

11. An apparatus according to claim 10, wherein active edges of the upright guide projections are curved in a concave manner.

12. An apparatus according to claim 11, wherein a plurality of upright guide projections are aligned along a curved line, a central portion of which is set back from the charge retentive member in the paper feeding direction.

* * * * *